US006621209B2

(12) United States Patent
Myojo et al.

(10) Patent No.: US 6,621,209 B2
(45) Date of Patent: Sep. 16, 2003

(54) FLUORESCENT LAMP HAVING A SPACER BETWEEN GLASS TUBES

(75) Inventors: Minoru Myojo, Osaka (JP); Hideki Yamauchi, Kyoto (JP); Tsutomu Takemura, Osaka (JP); Akio Kitada, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 89 days.

(21) Appl. No.: 09/940,260

(22) Filed: Aug. 27, 2001

(65) Prior Publication Data

US 2002/0024301 A1 Feb. 28, 2002

(30) Foreign Application Priority Data

Aug. 29, 2000 (JP) ..... 2000-259416

(51) Int. Cl.[7] ..... H01J 61/30; H01J 61/32; H01J 61/36

(52) U.S. Cl. ..... 313/493; 313/485; 313/573; 313/292; 362/225

(58) Field of Search ..... 313/573, 484, 313/485, 492, 493, 238, 244, 634, 635, 292; 362/225

(56) References Cited

U.S. PATENT DOCUMENTS 4,977,349 A 12/1990 Asakura et al. ..... 313/490

5,977,692 A * 11/1999 Itaya et al. ..... 313/37

FOREIGN PATENT DOCUMENTS

| | | |
|---|---|---|
| JP | 62-55864 | 4/1987 |
| JP | 62-90844 | 4/1987 |
| JP | 62-090844 | 4/1987 |
| JP | 62-264547 | 11/1987 |
| JP | 2-18264 | 2/1990 |
| JP | 03-102759 | 4/1991 |
| JP | 3-254059 | 11/1991 |
| JP | 10-269987 | 10/1998 |

* cited by examiner

*Primary Examiner*—Ashok Patel
*Assistant Examiner*—Karabi Guharay
(74) *Attorney, Agent, or Firm*—Merchant & Gould P.C.

(57) ABSTRACT

In a fluorescent lamp having a plurality of glass tubes that are connected with each other to form a discharge path, spacers that do not drop off even with insufficient accuracy of a gap between the glass tube are provided in a gap between the connected glass tubes, so as to improve the gap compression resistance and the torsion resistance. Each spacer is composed of a plurality of tonguelets and a bridge. The tonguelets are in contact with surfaces of the glass tubes and are connected by the bridge that is directed in an axial direction of the glass tubes.

9 Claims, 4 Drawing Sheets

FLUORESCENT LAMP HAVING A SPACER BETWEEN GLASS TUBES

BACKGROUND OF THE INVENTION

1. Field of the Invention

The present invention relates to a fluorescent lamp in which a discharge path is formed by connecting a plurality of glass tubes with each other.

2. Related Background Art

Conventionally, fluorescent lamps, each having a discharge path that is formed with a plurality of glass tubes connected with each other, have been known widely as so-called compact fluorescent lamps, bulb-formed fluorescent lamps, and double ring-shaped fluorescent lamps. As to a type of connection of glass tubes, a bridge connection type and a mold-connection type commonly are used for the foregoing lamps.

In the bridge connection-type fluorescent lamp, a stress is applied in such a direction to shrink a gap between connected glass tubes when the lamp is mounted to a lighting equipment. Configurations in each of which spacers are provided in a gap between glass tubes to increase the strength of the lamp against the stress are disclosed by, for instance, JP62-264547A, and JP05-76132B. In the case where accuracy of the gap between the glass tubes is high, such spacers placed in the gap are effective in reinforcing the strength of the lamp. Another configuration in which spacers, each composed of two pieces that fit each other so as to be prevented from dropping off, are set in the gap between sides of the glass tubes is disclosed by JP03-254059A.

In the case where the gap accuracy between the connected glass tubes is insufficient, a spacer tends to drop off at a position where the gap is wide. This drawback is particularly likely to occur in the double ring-shaped fluorescent lamp of the bridge connection type. Furthermore, in the case where the spacer composed of two pieces that fit each other is used, there is a drawback in that it is difficult to efficiently carry out the work of fitting the spacer in a gap between glass tubes.

Therefore, to solve the foregoing problems, it is an object of the present invention to provide a fluorescent lamp in which spacers are prevented from dropping off even with insufficient gap accuracy of glass tubes, and to which spacers are attached readily.

SUMMARY OF THE INVENTION

To achieve the foregoing object, a fluorescent lamp according to the present invention has a plurality of glass tubes that are connected with each other to form a discharge path, and a spacer that is provided in a gap between the glass tubes. In the fluorescent lamp, the spacer is composed of a plurality of tonguelets and a bridge, and the tonguelets are in contact with surfaces of the glass tubes and are connected by the bridge directed in an axial direction of the glass tubes.

According to this, a plurality of tonguelets are disposed in the gap between the glass tubes at a plurality of positions along the axial direction of the glass tubes, respectively. Therefore, it is possible to provide a fluorescent lamp with a high gap compression resistance and a high torsion resistance, in which the spacers hardly drop off even in the case where the width of the gap between the glass tubes varies.

Furthermore, in the foregoing fluorescent lamp, the spacer preferably is formed by connecting two tonguelets via the bridge.

Furthermore, in the foregoing fluorescent lamp, the glass tubes preferably are non-linear. In this configuration, the gap between the glass tubes is curved, thereby exerting a force to bend the bridge of the spacer. This generates a stress applied to the two tonguelets in the opposite direction of the stress caused in the bridge, thereby increasing the spacer grasping force. Consequently, even in the case where the gap between the glass tubes varies greatly, the spacers inserted at a position where the gap is wide are prevented from dropping off.

Furthermore, in the fluorescent lamp of the present invention, the glass tubes preferably are formed in a double ring shape. With this configuration, it is possible to provide a double ring-shaped fluorescent lamp with a high gap compression resistance and a high torsion resistance even in the case where the accuracy of the width of the gap is insufficient.

Furthermore, in the fluorescent lamp of the present invention, a distance between central lines of two adjacent tonguelets of the spacer preferably is in a range of 1/10 to 1/2 of a distance from a central point of the double ring to the gap in the double ring. Therefore, the stress exerted to the two tonguelets in opposite directions is never too small, thereby by no means causing the spacers to drop off. Also the stress is never too great, thereby by no means degrading the strength of the bridge portions of the spacers or the strength of the glass tubes. Thus, generally a sufficient spacer grasping and holding force can be secured.

Furthermore, in the foregoing fluorescent lamp, it is also preferable that the glass tubes are linear. In this configuration also, a plurality of tonguelets are disposed in the gap between the glass tubes at a plurality of positions along the axial direction of the glass tubes, respectively. Therefore, it is possible to provide a fluorescent lamp with a high gap compression resistance and a high torsion resistance, in which the spacers hardly drop off even in the case where the width of the gap between the glass tubes varies.

Furthermore, in the fluorescent lamp of the present invention, at least a portion of each of the spacers has elasticity. In this configuration, the spacers can be attached extremely easily only by pressing and fitting the spacers in the gap between the glass tubes.

Furthermore, in the fluorescent lamp of the present invention, the spacers preferably contain a transparent resin. This allows the lamp to light uniformly. As the transparent resin, polycarbonate or the like may be used. The use of polycarbonate allows the stress exerted to the tonguelets for supporting use to be maintained uniformly even with respect to thermal changes while the lamp is turned on.

DETAILED DESCRIPTION OF THE INVENTION

Figure 1:
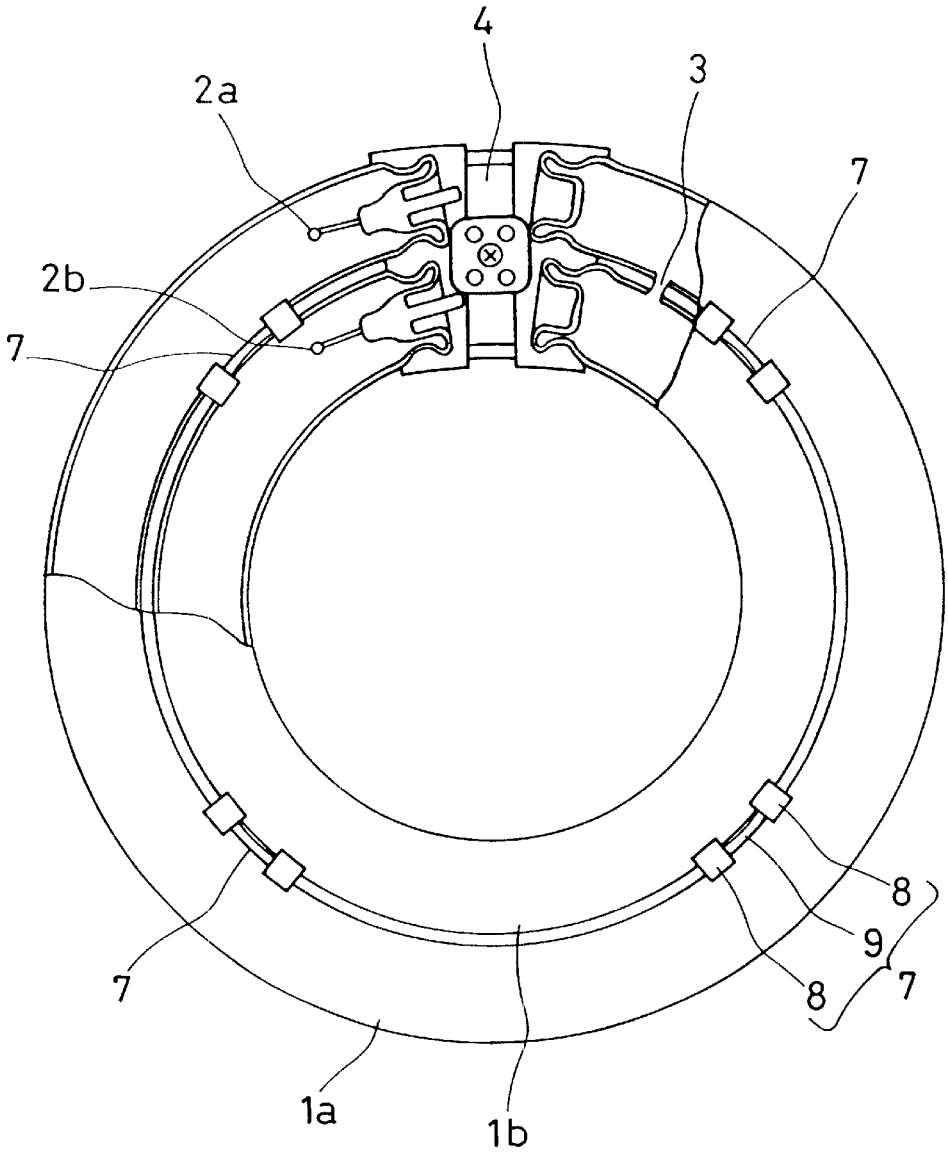
FIG. 1 is a partially cutaway plan view illustrating a configuration of a fluorescent lamp according to an embodiment of the present invention.

The following description will depict an embodiment of the present invention while referring to the drawings.

As illustrated in FIG. 1, a fluorescent lamp according to the present embodiment is a double ring-shaped fluorescent lamp including large and small glass tubes 1*a* and 1*b* that are provided in the double ring form. On internal surfaces of the glass tubes 1*a* and 1*b*, a fluorescent substance is applied. The glass tubes 1*a* and 1*b* are provided with electrode coils 2*a* and 2*b* on their ends on one side, respectively. The ends of the glass tubes 1*a* and 1*b* on the other side are sealed, and a bridge 3 for connecting the glass tubes 1*a* and 1*b* is provided in the vicinity of the sealed portions. By so doing, one discharge path is formed with the two glass tubes 1*a* and 1*b*.

After filling argon gas at an appropriate pressure (several hundred Pa) and mercury drops in the glass tubes 1*a* and 1*b*, a resin cap 4 is mounted on the glass tubes 1*a* and 1*b*. In a gap between the glass tube 1*a* and the glass tube 1*b*, spacers 7 are provided at several positions.

Figure 2:
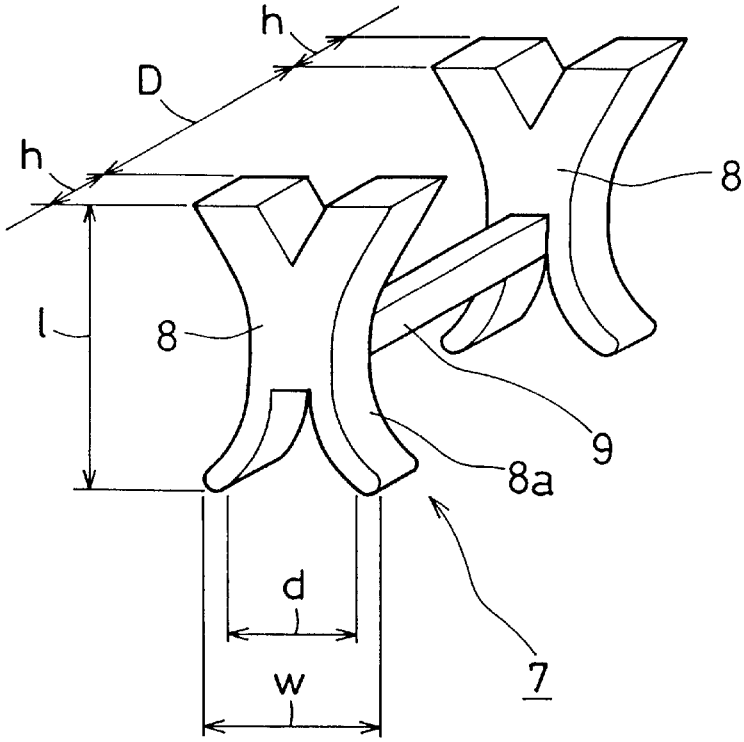
FIG. 2 is a perspective view illustrating a configuration of a spacer used in the fluorescent lamp shown in FIG. 1.

Each spacer 7 is formed, as shown in FIG. 2, with two supporting tonguelets 8 that are connected with each other by a linear bridge 9. The spacer 7 is inserted readily in the gap between the glass tubes 1*a* and 1*b* so that supporting surfaces 8*a* of the supporting tonguelets 8 are in contact with a surface of the glass tubes, with the bridge 9 directed in the glass tube axis direction.

To facilitate the attachment of the spacers 7 to the glass tubes 1*a* and 1*b*, a part or an entirety of each spacer 7 preferably is made of an elastic material. More specifically, it preferably is made of a synthetic resin of a rubber type such as silicone or a heat resistant resin such as polycarbonate. At least portions of the supporting tonguelets 8 that come in the front in the insertion direction when the spacer 7 is inserted into the gap between the glass tubes 1*a* and 1*b* (hereinafter referred to as front portions) need to have elasticity such that an outer width w of the leading portion becomes smaller than a width of the gap between the glass tubes 1*a* and 1*b*. Furthermore, an inner width d may be determined according to the elasticity of a material forming the front portions.

Incidentally, the bridge 9 bends when the spacer 7 is inserted to the gap between the glass tubes 1*a* and 1*b*, thereby applying a stress to the two supporting tonguelets 8 in the opposite direction of the stress caused in the bridge, respectively, so that the bridge 9 acts to prevent the spacer 7 from dropping off. Therefore, it is necessary to select, as a material for the bridge 9, a material with such a sufficient degree of elasticity as to prevent the spacer 7 from dropping off.

A distance (D+h in the case where the two tonguelets have the same thickness) between central lines of the two supporting tonguelets 8 of the spacer 7 preferably is in a range of 1/10 to 1/2 of a distance from the center of the double ring of the glass tubes 1*a* and 1*b* to the center of the gap between the glass tubes 1*a* and 1*b*, so that the state of supporting the glass tubes 1*a* and 1*b* is maintained surely without being affected by a variation of the width of the gap between the glass tubes 1*a* and 1*b*. Incidentally, the following relationship is satisfied:

$$R=(d_{1a}+d_{1b})/4$$

where R represents a distance from the center of the double ring of the glass tubes 1*a* and 1*b* to the center of the gap between the glass tubes 1*a* and 1*b*, $d_{1a}$ represents an outer diameter of the ring of the glass tube 1*a*, and $d_{1b}$ represents an inner diameter of the ring of the glass tube 1*b*.

Incidentally, the spacer shape is not limited to the example shown in FIG. 2, but it may be in any shape and in any size as long as no problem arises when it is attached.

The following description will depict further concrete examples of the fluorescent lamp according to the present embodiment.

Glass tubes 1*a* and 1*b* with an outer tube diameter of 20 mm were used to form a double ring-shaped fluorescent lamp as shown in FIG. 1. The fluorescent lamp had a rated input of 100 W, an outer diameter $d_{1a}$ of the outer ring of the double ring of 400 mm, and an inner diameter $d_{1b}$ of the inner ring of 314 mm.

Spacers 7 each of which was composed of two supporting tonguelets 8 and a bridge 9 in the shape shown in FIG. 2 were formed with polycarbonate, which is a transparent resin, and the spacers were disposed at four positions in a gap in the double ring of the fluorescent lamp. The use of the transparent resin allows the lamps to light uniformly, and further the use of polycarbonate ensures stabilization of stress exerted to the two tonguelets 8 even with respect to thermal changes while the lamp is turned on.

It should be noted that a distance from the common center of the double ring to the center of the gap in the double ring was approximately 178.5 mm. A size of the gap of the double ring was at least 2.0 mm, and at most 4.5 mm.

Dimensions of the spacer 7 were as follows (dimension marks are shown in FIG. 2):

| | |
|---|---|
| height: | h = 5.0 mm |
| outer width of the supporting tonguelet: | w = 4.7 mm |
| inner width of the supporting tonguelet: | d = 1.4 mm |
| length: | l = 11.5 mm |
| length of the bridge: | D = 40.0 mm |

Figure 3:
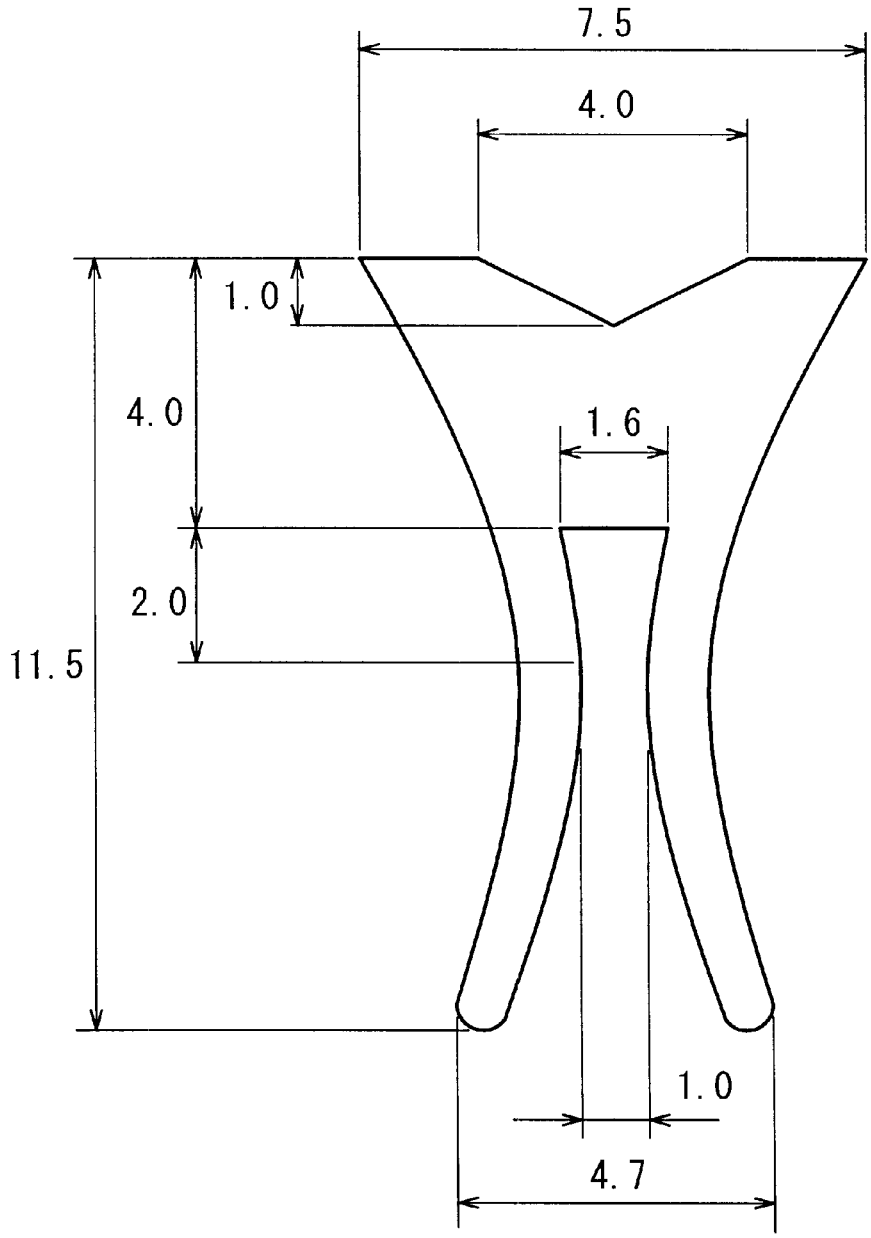
FIG. 3 is a plan view showing dimensions of supporting tonguelets of the spacer shown in FIG. 2.

Dimensions of the supporting tonguelet 8 are shown in FIG. 3 in detail.

A distance (D+h) between central lines of the two supporting tonguelets 8 was 45 mm, which was approximately 1/4 of a distance R (approximately 178.5 mm) from the center of the double ring to the center of the gap in the double ring. If the distance between the central lines of the two supporting tonguelets 8 is too short, the degree of bending of the bridge 9 is small, and the stress that is generated between the two supporting tonguelets 8 decreases. Consequently, the spacer 7 likely drops off at the position where the gap is wide. On the contrary, if the distance between the central lines of the two supporting tonguelets 8 is too long, the degree of bending of the bridge 9 is great, and the foregoing stress increases. Consequently, the strength of bridge 9 and the strength of the glass tubes likely decrease at the position where the gap is narrow.

Taking the width of the gap and the degree of bending of the bridge 9 into consideration, the distance between the central lines of the supporting tonguelets 8 preferably is not less than 1/10 and not more than 1/2 of the distance from the center of the double ring to the center of the gap between the glass tubes. Incidentally, it was confirmed by an experiment that the grasping force of the spacer 7 is insufficient in the case where the ratio is less than 1/10. On the other hand, in the case where the ratio exceeds 1/2, it also was confirmed by an experiment that the bridge 9 is deteriorated at the position where the gap is narrow and in their vicinities.

Without the spacers 7, the glass tubes 1*a* and 1*b* in the double ring form are supported only at a bridge connecting portion, and such a fluorescent lamp is immediately damaged when it is inappropriately handled upon being mounted on a lighting equipment, or when fluorescent-lamp-mounting-use members provided in a lighting equipment are not suitable. The fluorescent lamp of the present invention, however, is provided with the spacers 7, and hence it is resistant to a certain degree of such a stress as gap compression and torsion.

Figure 4:
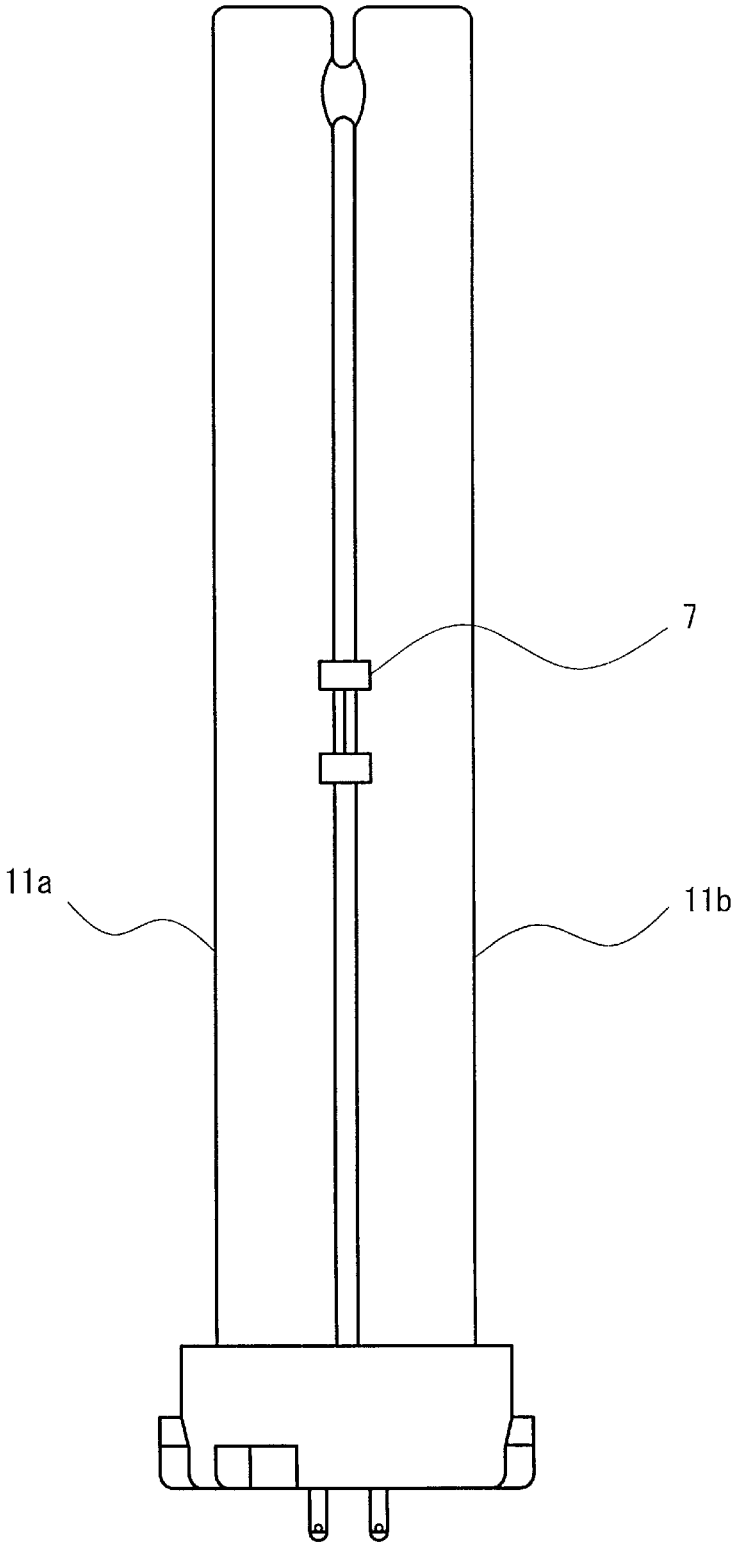
FIG. 4 is a plan view illustrating a configuration of a fluorescent lamp according to another embodiment of the present invention.

It should be noted that the present embodiment is described by taking as an example the double ring-shaped fluorescent lamp of the bridge connection type, but the present invention is not limited to this type of the fluorescent lamp, but is widely applicable to known fluorescent lamps including those of the mold connection type disclosed by JP7(1995)-46598A. Furthermore, the present invention is applicable not only to the ring-shaped fluorescent lamp, but also to a linear fluorescent lamp formed by connecting linear glass tubes 11*a* and 11*b* and attaching the spacers 7 as shown in FIG. 4.

The foregoing embodiment of the present invention is not limited to the case with the aforementioned material, size, rating, shape, number of component members, etc., but is applicable in wider ranges of the same as long as the glass tube supporting strength is effectively improved in the fluorescent lamp of the glass tube connection type.

As described above, according to the present invention, spacers, each of which is composed of supporting tonguelets connected by a linear bridge, are inserted in a gap between glass tubes. By so doing, the dropping-off of the spacers do not take place even in the case where the gap accuracy of the glass tubes is insufficient in a glass-tube-connected fluorescent lamp, and therefore, it is possible to provide a fluorescent lamp with a high gap compression resistance and a high torsion resistance.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fluorescent lamp having a plurality of glass tubes that are connected with each other to form a discharge path, and a spacer that is provided in a gap between the glass tubes, wherein:

the spacer comprises a plurality of tonguelets and a bridge, the tonguelets being in contact with surfaces of the glass tubes and being connected by the bridge directed in an axial direction of the glass tubes.

2. The fluorescent lamp according to claim 1, wherein the spacer is formed by connecting two tonguelets via the bridge.

3. The fluorescent lamp according to claim 1, wherein the glass tubes are non-linear.

4. The fluorescent lamp according to claim 3, wherein the glass tubes are formed in a double ring shape.

5. The fluorescent lamp according to claim 4, wherein a distance between central lines of two adjacent tonguelets of the spacer is in a range of 1/10 to 1/2 of a distance from a central point of the double ring to a center of the gap in the double ring.

6. The fluorescent lamp according to claim 1, wherein the glass tubes are linear.

7. The fluorescent lamp according to claim 1, wherein at least a portion of each of the spacers has elasticity.

8. The fluorescent lamp according to claim 1, the spacers contain a transparent resin.

9. The fluorescent lamp according to claim 8, wherein the transparent resin is polycarbonate.

* * * * *